US007845961B2

(12) United States Patent
Zhu et al.

(10) Patent No.: US 7,845,961 B2
(45) Date of Patent: Dec. 7, 2010

(54) ELECTRICAL CONNECTOR WITH IMPROVED CONTACTS ARRANGEMENT

(75) Inventors: Zi-Qiang Zhu, Kunshan (CN); Jerry Wu, Irvine, CA (US); Hong-Qiang Han, Kunshan (CN); Chen-Xi Wang, Kunshan (CN)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 12/683,443

(22) Filed: Jan. 7, 2010

(65) Prior Publication Data

US 2010/0173524 A1 Jul. 8, 2010

(51) Int. Cl.
*H01R 13/648* (2006.01)
*H01R 4/66* (2006.01)

(52) U.S. Cl. ..... 439/108; 439/607.05; 439/941; 439/79

(58) Field of Classification Search ..... 439/607.01, 439/79, 108, 607.05, 607.27, 941, 660, 101
See application file for complete search history.

(56) References Cited

U.S. PATENT DOCUMENTS 6,808,420 B2 * 10/2004 Whiteman et al. ..... 439/607.08
7,303,410 B2 12/2007 Saito

* cited by examiner

*Primary Examiner*—Javaid Nasri
(74) *Attorney, Agent, or Firm*—Wei Te Chung; Andrew C. Cheng; Ming Chieh Chang

(57) ABSTRACT

An electrical connector (100) includes an insulative housing (1), a set of contacts (2) retained in the insulative housing and arranged in one row, and a metal shell (3) covering the insulative housing. The contacts (2) consist of a first type of grounding contacts (G) and a second type of a set of pairs of differential contacts (21, 22, 23, 24). The metal shell has a receiving space (30) for receiving a matchable plug.

8 Claims, 6 Drawing Sheets

ELECTRICAL CONNECTOR WITH IMPROVED CONTACTS ARRANGEMENT

BACKGROUND OF THE INVENTION

1. Field of the Invention

The present invention relates to an electrical connector, and more particularly to electrical connectors with improved contacts arrangement.

2. Description of Related Art

Type C HDMI (High-Definition Multimedia Interface) connectors present as a medium being widely used in mobiles phones and other electronic devices for electrically connecting the electronic devices with each other to transmit signals. The type C HDMI connector has nineteen contacts arranged in one row and including three pairs of differential contacts (Data+, Data−), a pair of clock contacts (Clock+, Clock−), five grounding contacts, a CEC signal contact, a SCL signal contact, a SDA signal contact, a reserved signal contact, a +5V power contact, and a hot plug detect contact.

The type C HDMI connector has so many types of the contacts sorted in function that the chipset designed for the type C HDMI connector is complicated. The type C HDMI connector need many contacts to transmit the so many different types of data, and the manufacturing costs of the type C HDMI connector is increased.

Hence, an improved electrical connector with an improved contacts arrangement is desired to overcome the above problems.

BRIEF SUMMARY OF THE INVENTION

According to one aspect of the present invention, an electrical connector comprises an insulative housing, a plurality of contacts retained in the insulative housing and arranged in one row, and a metal shell covering the insulative housing. The contacts consist of a first type of grounding contacts and a second type of a plurality of pairs of differential contacts. The metal shell has a receiving space for receiving a matchable plug.

According to another aspect of the present invention, an electrical connector comprises an insulative housing having a base and a tongue plate, a plurality of contacts having contacting portions arranged on one side of the tongue plate, and a metal shell covering the insulative housing. The contacts consist of a first type of grounding contacts and a second type of a plurality of pairs of differential contacts. The differential contacts comprise a third pair of differential contacts and a fourth pair of differential contacts. the grounding contacts comprise at least two grounding contacts arranged between the third and the fourth pair of differential contacts. The metal shell has a receiving space for receiving a matchable plug and for the tongue plate extending into.

The foregoing has outlined rather broadly the features and technical advantages of the present invention in order that the detailed description of the invention that follows may be better understood. Additional features and advantages of the invention will be described hereinafter which form the subject of the claims of the invention.

BRIEF DESCRIPTION OF THE DRAWINGS

For a more complete understanding of the present invention, and the advantages thereof, reference is now made to the following descriptions taken in conjunction with the accompanying drawings, in which.

DETAILED DESCRIPTION OF THE PREFERRED EMBODIMENT

Figure 1:
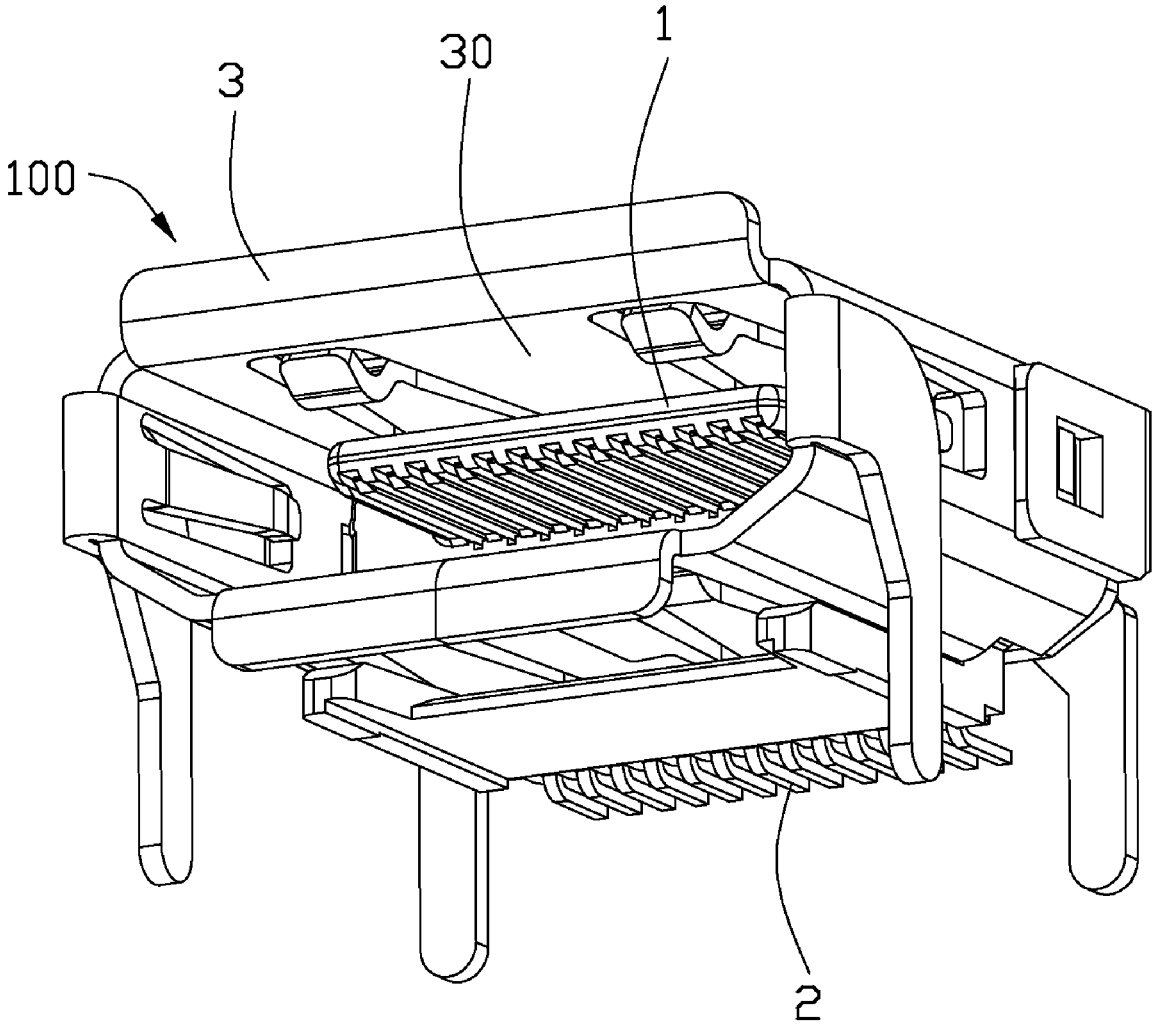
FIG. 1 is a perspective view of an electrical connector according to an embodiment of the present invention.

In the following description, numerous specific details are set forth to provide a thorough understanding of the present invention. However, it will be obvious to those skilled in the art that the present invention may be practiced without such specific details. In other instances, well-known circuits have been shown in block diagram form in order not to obscure the present invention in unnecessary detail. For the most part, details concerning timing considerations and the like have been omitted inasmuch as such details are not necessary to obtain a complete understanding of the present invention and are within the skills of persons of ordinary skill in the relevant art.

Referring to FIGS. 1-5, an electrical connector 100 according to the present invention is disclosed. The electrical connector 100 includes an insulative housing 1, a plurality of contacts 2 retained in the insulative housing 1, and a metal shell 3 covering the insulative housing 1 and defining a receiving space 30 for receiving a matchable plug (not shown) which mates with the electrical connector 100. The metal shell 3 includes a front shell 38 and a rear shell 39 coupled to the front shell 38.

The insulative housing 1 being molded of dielectric material such as plastic or the like, has a base 11 and a tongue plate 12 extending horizontally forwardly from a front face of the base 11 into the receiving space 30. The base 11 has a depression portion 112 recessed from a middle position of a top face to retain the rear shell 39. The base 11 has four projections 116 extending outwardly from four corners of a rear face for preventing the front shell 38 from moving backwardly. The tongue plate 12 has an upper face 121, and a lower face 122 opposite to the upper face 121 and defining a set of passageways 1221 arranged alternatively thereon for receiving the contacts 2 respectively. In this embodiment, the tongue plate 12 is integrally formed with the base 11. The depression portion 112 has a bottom face which is approximately located at a same plane with the upper surface 121 of the tongue 12 for decreasing a height of the insulative housing 1. It is also to be understood that, in other embodiments, the tongue plate 12 and the base 11 can be molded of dielectric material respectively and assembled together to form the insulative housing 1. The insulative housing 1 has a an accessorial board 13 extending forwardly from bottom of the base 11 and located below the front shell 38 for supporting and strengthening the front shell 38. The accessorial board 13 is spaced apart from the tongue 12 along the height direction and parallel to the tongue 12. The accessorial board 13 has a pair of posts 135 for decreasing a contact area between the electrical connector 100 and a Printed Circuit Board (PCB, not shown), and a platform 136 located between the posts 135 and connecting the posts 135. The platform 136 has a slanted plane 137 for guiding the front shell 38.

Referring to FIGS. 1 to 5, the contacts 2 each having a same shape are arranged in one row along a transverse direction and consist of a first type of grounding contacts and a second type of a plurality of differential contacts. The grounding contacts comprise five grounding contacts G. The differential contacts comprise four pair of differential contacts including a first, a second, a third, and a fourth pair of differential contacts 21, 22, 23, 24. Each pair of differential contacts include a +data contact and a −data contact. Each pair of differential contacts arranged between each two adjacent grounding contacts G. Therefore, the interference between each two adjacent pair of the differential contacts can be reduced. The first, second, and third pair of differential contacts 21, 22, 23 uni-directionally transmit data, the fourth pair of differential contacts 24 are arranged at one side of the third pair of differential contacts 23 and bi-directionally transmit hybrid data. The four pair of differential contacts enable the electrical connector 100 to supply a wider transmission bandwidth and increase data transmission speed. The fourth pair of differential contacts 24 enable the electrical connector 100 to bi-directionally transmit a high-speed hybrid data. In this embodiment, the contacts 2 consist of a first grounding contact G, a first pair of differential contacts 21, a second grounding contact G, a second pair of differential contacts 22, a third grounding contact G, a third pair of differential contacts 23, a fourth grounding contact G, a fourth pair of differential contacts 24, and a fifth grounding contact G which are arranged orderly along the transverse direction of the insulative housing 1. The contacts 2 having five grounding contacts G and four pair of differential contacts consist of only two types in function, the chipset designed for the connector 100 will be simplified. Furthermore, the fewer amount of the contacts 2 can miniature the electrical connector 100.

Figure 2:
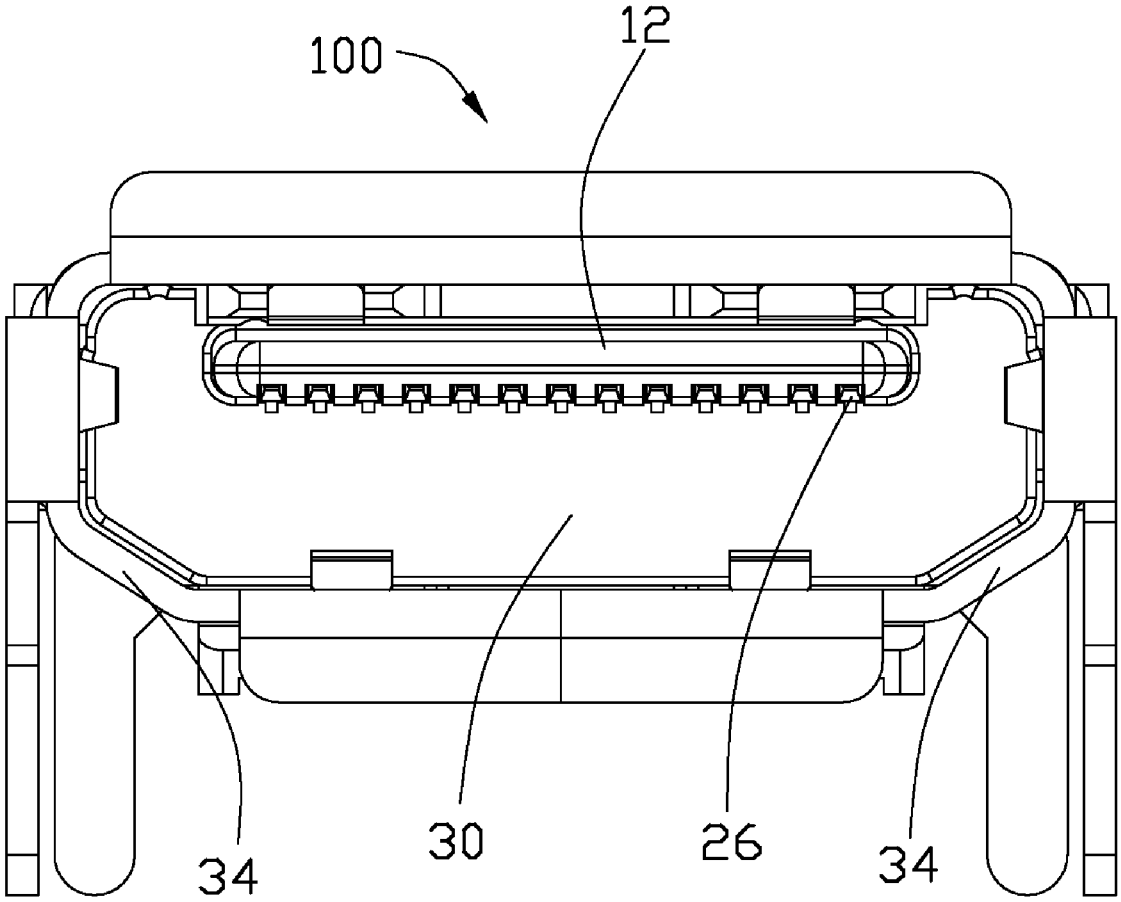
FIG. 2 is a front elevational view of the electrical connector shown in FIG. 1.
Figure 3:
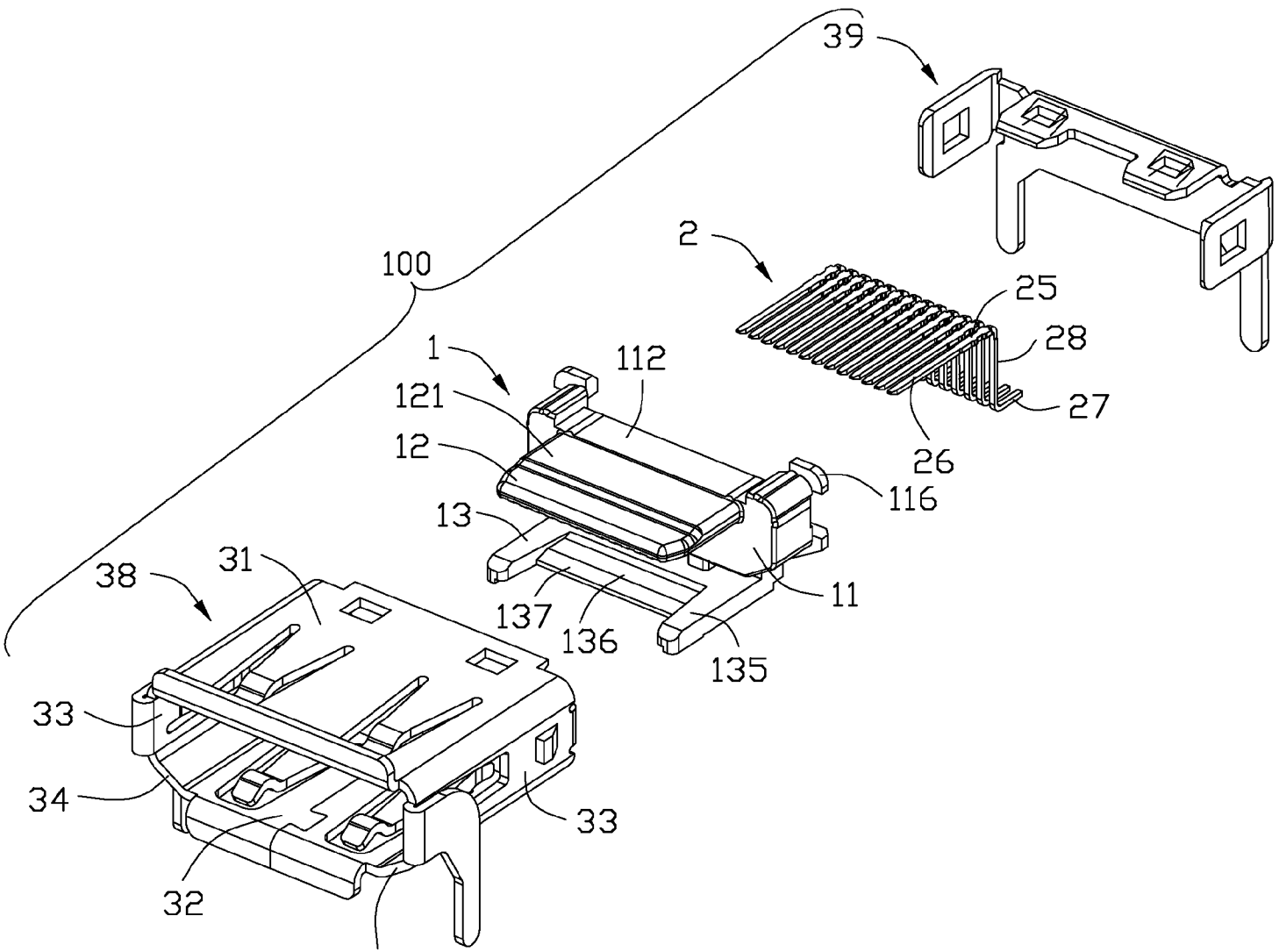
FIG. 3 is an exploded view of the electrical connector shown in FIG. 1.
Figure 4:
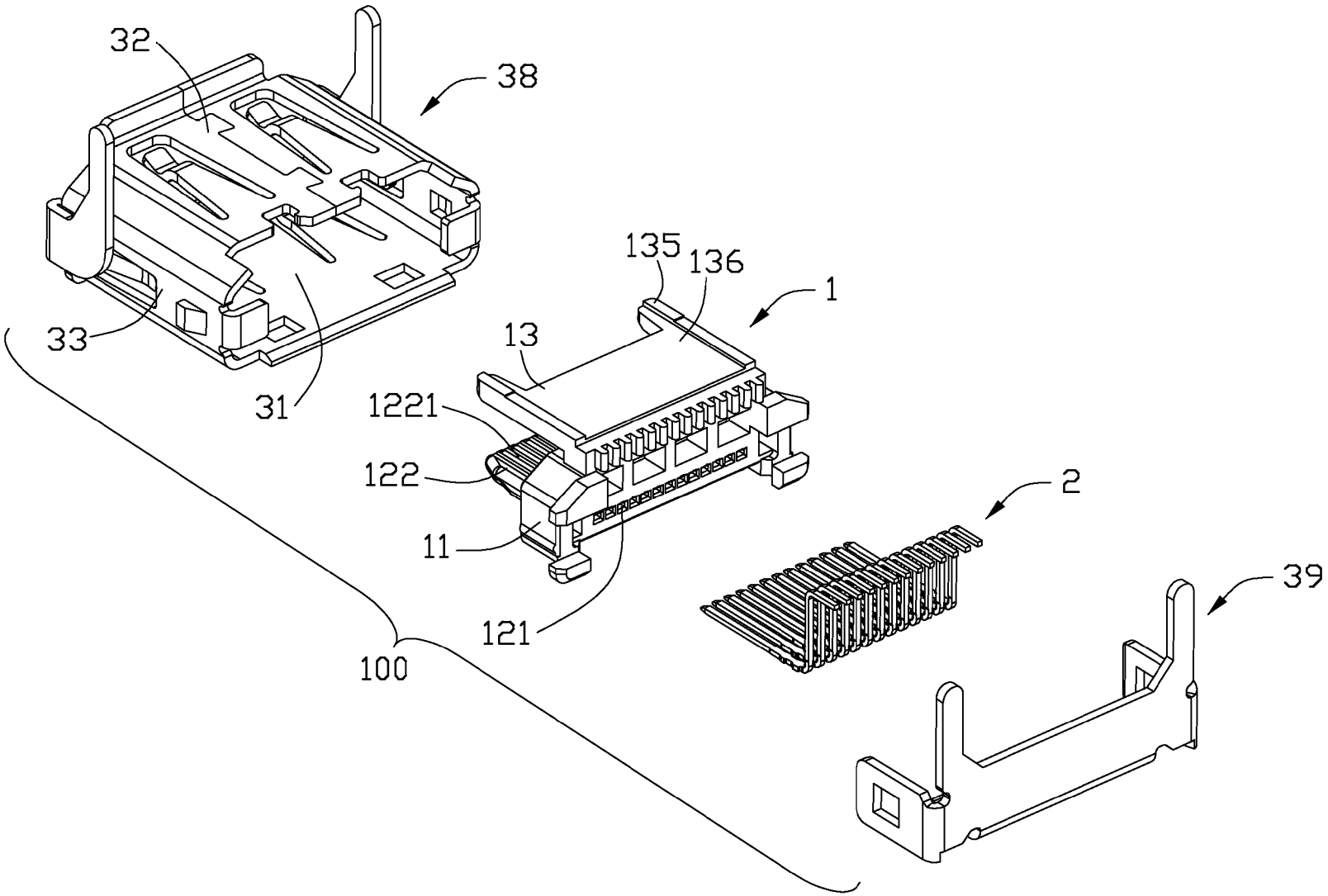
FIG. 4 is another exploded view of the electrical connector shown in FIG. 1.
Figure 5:
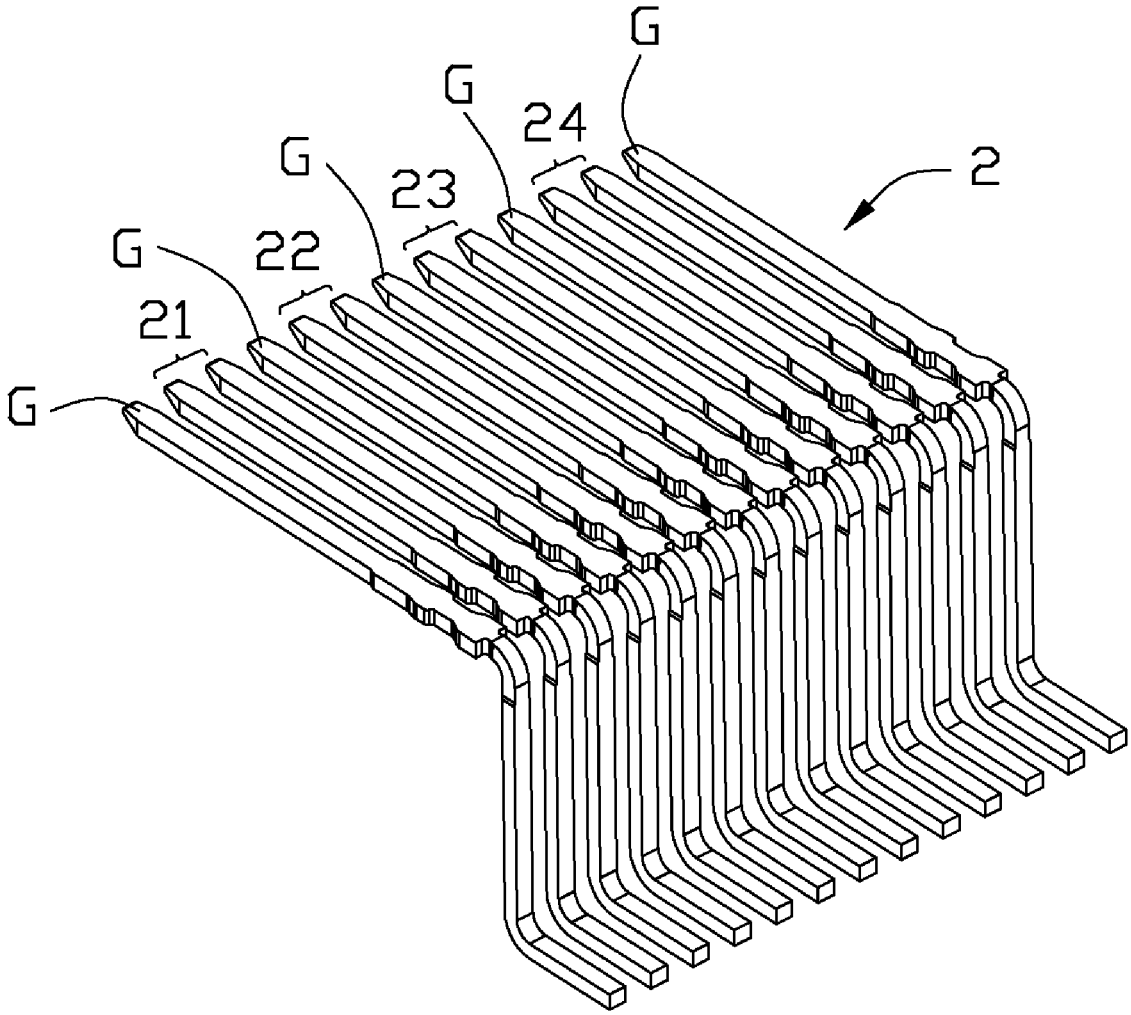
FIG. 5 is an enlarged perspective view of contacts of the electrical connector shown in FIG. 1.

Referring to FIG. 3, each contact 2 has a retaining portion 25 retained in the base 11, a flat contacting portion 26 received in the passageway 1221 and extending forwardly from a front end of the retaining portion 25, a tail portion 27 for being soldered directly onto a surface of the PCB, and a connecting portion 28 connecting the retaining portion 25 and the tail portion 27. the contacting portion 26 are exposed to the receiving space 30 to electrically mate with the matchable plug. The contacting portion 26 and the retaining portion 25 are arranged in a horizontal plane parallel to another horizontal plane in which the tail portion 27 are arranged, the connecting portions 28 are arranged in a vertical plane perpendicular to the contacting portions 26 and the tail portions 27. In another embodiment, the tail portions 27 can be mounted through a hole of the PCB and extend vertically perpendicular to the contacting portions 26, the tail portions 27 can be arranged in two or three rows. Referring to FIG. 2, all of the contacting portions 26 are arranged in one row and received in the passageways 1221 on the lower face 122 of the tongue plate 12 so as to decrease thickness of the tongue plate 12 in a height direction.

In this embodiment, the contacts 2 are stamped from a contact carrier (not shown) and assembled to the insulative housing 1. In other embodiments, the contact 2 can be integrally molded into the insulative housing 1. Furthermore, the tongue plate 12 can be replaced by a printed circuit board (PCB), and gold fingers on the PCB will replace the contacting portion 26 to electrically mate with the matchable plug.

The front shell 38 has a top wall 31, a bottom wall 32, a pair of side walls 33, and a pair of connecting walls 34 connecting the bottom wall 32 and the side walls 33. The receiving space 30 is surrounded by the top wall 31, the bottom wall 32, the side walls 33, and the connecting walls 34. The bottom wall 32 is supported by the accessorial board 13. In this embodiment, the connecting walls 34 extend in an inclined plane and are higher than the bottom wall 32 so as to prevent the unmatchable plug from being inserted into the receiving space 30, in another embodiment, the connecting walls 34 can extend in a curve plane bending downwardly and lower than the bottom wall 32.

Figure 6:
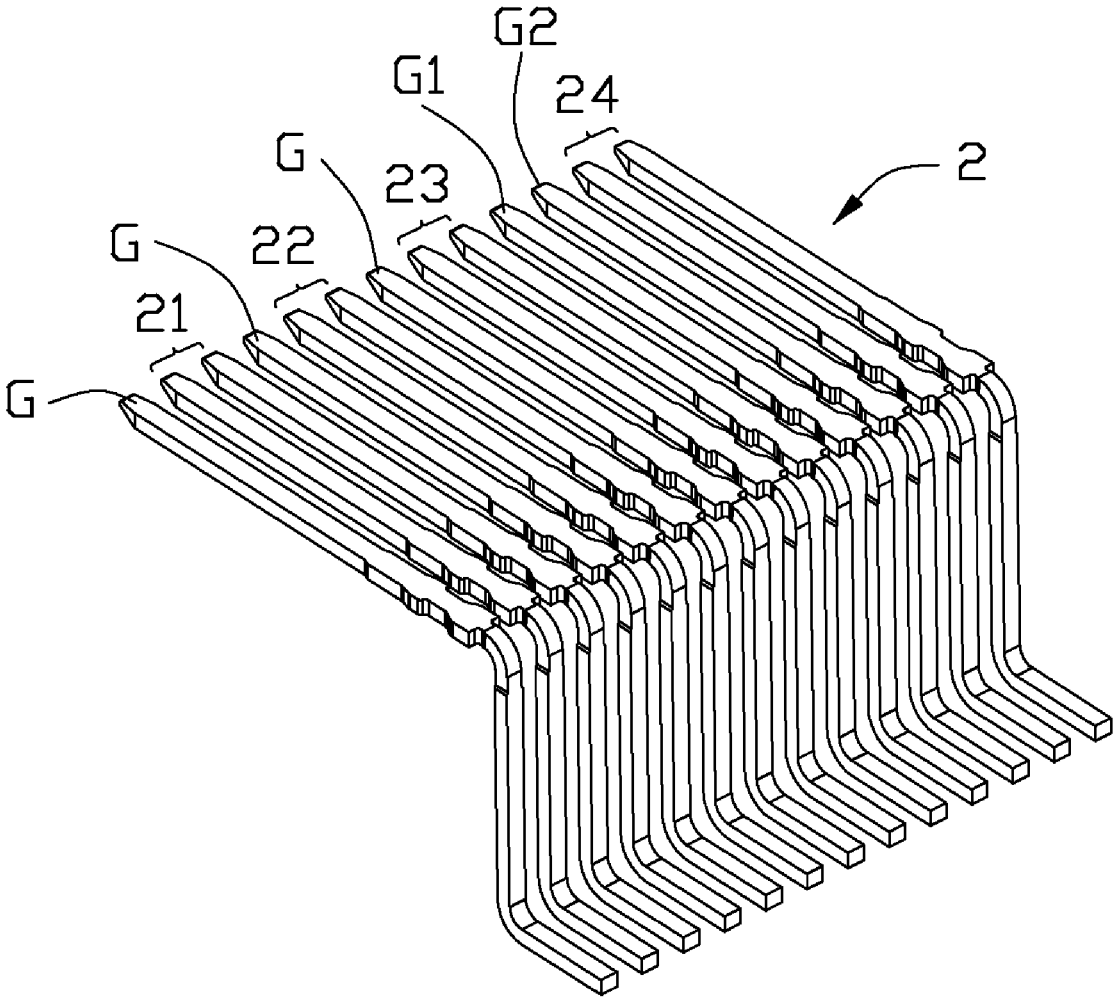
FIG. 6 is an enlarged perspective view of contacts of an electrical connector according to another embodiment of the present invention.

Referring to FIG. 6, the electrical connector in another embodiment of the present invention, only the contacts 2 have been modified, therefore, the other components of the connector are not described. the first, the second, and the third pairs of differential contacts 21, 22, 23 which uni-directionally transmit data and three grounding contacts G are arranged alternatively, the third pair of differential contacts 23 are arranged at outside, a pair of grounding contacts G1, G2 are arranged between the third pair of differential contacts 23 and the fourth pair of differential contacts 24 which bi-directionally transmit hybrid data. The fourth pair of differential contacts 24 are located in an outermost side of the contacts 2. The grounding contact G1 of the two grounding contacts G1, G2 is arranged adjacent to the third pair of differential contacts 23, the other grounding contact G2 is arranged adjacent to the fourth pair of differential contacts 24. In this embodiment, the contacts consist of a first grounding contact G, a first pair of differential contacts 21, a second grounding contact G, a second pair of differential contacts 22, a third grounding contact G, a third pair of differential contacts 23, a pair of fourth grounding contacts G1, G2, and a fourth pair of differential contacts 24 which are arranged orderly along the transverse direction of the insulative housing 1. The space between the third and the fourth pair of differential contacts 23, 24 can be increased, the interference between the third and the fourth pair of differential contacts 23, 24 can be reduced more effectively.

It is to be understood, however, that even though numerous, characteristics and advantages of the present invention have been set fourth in the foregoing description, together with details of the structure and function of the invention, the disclosed is illustrative only, and changes may be made in detail, especially in matters of number, shape, size, and arrangement of parts within the principles of the invention to the full extent indicated by the broad general meaning of the terms in which the appended claims are expressed.

What is claimed is:

1. An electrical connector comprising: an insulative housing; a plurality of contacts retained in the insulative housing and arranged in one row, the contacts consisting of a first type of grounding contacts and a second type of plural pairs of differential contacts; and a metal shell covering the insulative housing, the metal shell having a receiving space for receiving a matchable plug; wherein the differential contacts comprise three pairs of differential contacts for unidirectionally transmitting data and a fourth pair of differential contacts for bi-directionally transmitting hybrid data, the grounding contacts comprise five grounding contacts; wherein each pair of some pairs of differential contacts are arranged between each two adjacent grounding contacts; wherein said three pairs of differential contacts and three of the five grounding contacts are arranged alternatively, the other two of the five grounding contacts are arranged between the fourth pair of differential contacts and one of the three pairs of differential contacts; wherein one of the other two grounding contacts is arranged adjacent to the one pair of differential contacts, the other one is arranged adjacent to the fourth pair of differential contacts; wherein each contact has a same shape and has a retaining portion retained in the insulative housing, a contacting portion extending from one end of the retaining portion for mating with the matchable plug, a tail portion for being mounted on a printed circuit board, and a connecting portion connecting the other end of the retaining portion and the tail portion, the insulative housing has a base for retaining the retaining portion, and a tongue plate extending into the receiving space and defining a plurality of passageways on one side thereof for receiving the contacting portion.

2. The electrical connector according to claim 1, wherein the contacts consist of a first grounding contact, a first pair of differential contacts, a second grounding contact, a second pair of differential contacts, a third grounding contact, a third pair of differential contacts, a pair of fourth grounding contacts, and a fourth pair of differential contacts which are arranged orderly along a transverse direction of the insulative housing.

3. The electrical connector according to claim 1, wherein the metal shell has a top wall, a bottom wall, a pair of side walls, and a pair of connecting walls all of which surround the receiving space, the connecting walls connect the bottom wall and the side walls to prevent an unmatchable plug from being inserted into the receiving space.

4. An electrical connector comprising:

an insulative housing including a base with a mating tongue extending forwardly therefrom, an accessorial board unitarily configured to be seated upon a printed circuit board and formed on a bottom portion of the base and spaced, along a vertical direction, below the mating tongue in a parallel relation;

a plurality of contacts disposed in the housing with contacting sections extending in a front-to-back direction, which is perpendicular to said vertical direction, and exposed upon a surface of said mating tongue under condition that said contacts are categorized with differential pairs and grounding contacts alternately arranged with each other in a transverse direction perpendicular to both said front-to-back direction and said vertical direction; and a frame like metallic shell rearwardly assembled to the housing and enclosing the mating tongue to define a mating port therein under condition that a rear portion of said shell is supported upon the accessorial board, a plurality of resilient tangs unitarily extend from the shell into the mating port and adapted to be outwardly deflected once a plug is inserted into the mating port; wherein said accessorial board is further equipped, in a front portion thereof, with a pair of horizontal posts spaced from each other with therebetween a cavity dimensioned to allow outward and downward deflection of said resilient tangs when said plug is inserted into the mating port.

5. The electrical connector as claimed in claim 4, wherein said shell includes a flange downwardly extends from a front bottom edge thereof to protectively hide said cavity of the accessorial board behind.

6. The electrical connector as claimed in claim 4, wherein the shell defines a pair of chamfered structures respectively beside the corresponding posts.

7. The electrical connector as claimed in claim 4, wherein said accessorial board defines a slanted plane behind the cavity for facilitating assembling of the shell to the housing.

8. The electrical connector as claimed in claim 4, wherein said accessorial board is equipped with a comb structure to position and regulate tails of the contacts.

* * * * *